US007276889B2

(12) United States Patent
Gan et al.

(10) Patent No.: US 7,276,889 B2
(45) Date of Patent: Oct. 2, 2007

(54) DETECT/MODULATE CIRCUIT

(75) Inventors: Wee-Kuan Gan, Taipei (TW); Chih-Jen Hsu, Taipei (TW)

(73) Assignee: Phison Electronics Corporation, Hsinchu (TW)

( * ) Notice: Subject to any disclaimer, the term of this patent is extended or adjusted under 35 U.S.C. 154(b) by 153 days.

(21) Appl. No.: 11/163,517

(22) Filed: Oct. 21, 2005

(65) Prior Publication Data

US 2007/0090823 A1 Apr. 26, 2007

(51) Int. Cl.
*G05F 1/40* (2006.01)

(52) U.S. Cl. ..... 323/284; 323/313; 327/512; 365/226

(58) Field of Classification Search ..... 323/282–288, 323/312–316; 327/143, 198, 512–513, 270, 327/509; 365/226, 225.7
See application file for complete search history.

(56) References Cited

U.S. PATENT DOCUMENTS 5,671,149 A * 9/1997 Brown ..... 702/64
5,774,734 A * 6/1998 Kikinis et al. ..... 713/300
6,104,221 A * 8/2000 Hoon ..... 327/143
6,412,977 B1 * 7/2002 Black et al. ..... 374/178
6,624,685 B2 * 9/2003 Shih et al. ..... 327/541
6,975,539 B2 * 12/2005 Tran ..... 365/185.2
7,205,755 B2 * 4/2007 Ito et al. ..... 323/316

* cited by examiner

*Primary Examiner*—Rajnikant B. Patel
(74) *Attorney, Agent, or Firm*—Jianq Chyun IP Office

(57) ABSTRACT

A detect/modulate circuit comprises a plurality of modulate resistors connected to a main resistor of a bandgap in series, and each module resistor is connected to a transistor switch in parallel, and each transistor switch is connected to a logic controller, and the logic controller is connected in sequence to a plurality of detect circuits and fuses corresponding to the quantity of the transistor switches. When the detect circuit receives a low-to-high power-on reset signal to detect whether or not the fuse is fused, the detect circuit will issue a voltage level signal "0" for the fuse being not fused or a voltage level signal "1" for the fuse being fused to the logic controller. The logic controller converts the received voltage level signal according to a logic conversion table to control the electric connection of the corresponding transistor switch, so as to fine turn the main resistance of the bandgap.

5 Claims, 6 Drawing Sheets

| Fuse States | | | Output voltage |
|---|---|---|---|
| TC←→TB (4R) | TB←→TA (2R) | TA←→GND (1R) | |
| Short | Short | Short | VBG-3ΔV |
| Short | Short | Open | VBG-2ΔV |
| Short | Open | Short | VBG-1ΔV |
| Short | Open | Open | VBG |
| Open | Short | Short | VBG+1ΔV |
| Open | Short | Open | VBG+2ΔV |
| Open | Open | Short | VBG+3ΔV |
| Open | Open | Open | VBG+4ΔV |

*FIG.2*

| Fuse States | | | Transterred logic (B2, B1, B0) | Output voltage |
|---|---|---|---|---|
| TC ↔ GND | TB ↔ GND | TA ↔ GND | | |
| Short | Short | Short | 100 | VBG |
| Short | Short | Open | 101 | VBG-1ΔV |
| Short | Open | Short | 110 | VBG-2ΔV |
| Short | Open | Open | 111 | VBG-3ΔV |
| Open | Short | Short | 011 | VBG+1ΔV |
| Open | Short | Open | 010 | VBG+2ΔV |
| Open | Open | Short | 001 | VBG+3ΔV |
| Open | Open | Open | 000 | VBG+4ΔV |

*FIG. 4*

DETECT/MODULATE CIRCUIT

BACKGROUND OF THE INVENTION

1. Field of the Invention

The present invention relates to a detect/modulate circuit, and more particularly to a detect/modulate circuit using transistor switches to modulate a bandgap.

2. Description of Related Art

As the semiconductor design becomes a mainstream of the present semiconductor industry, the development of 3C and system-on-chip (SOC) becomes very popular under this trend. If low price, high performance, power saving, light, thin, short, compact and portability are taken into consideration, a more precise design technology accompanied with a better manufacturing process can achieve the request. At present, the number of transistors in per unit chip is increasing, and the integration of different elements is a significant achievement made by chip developers.

For all integrated circuits, a bandgap is needed to produce a reference voltage. The bandgap is to provide a stable temperature and voltage changed voltage. However, the bandgap will produce a deviation of output voltage due to a change of semiconductor process. To solve such output voltage deviation, related manufacturers adopt a plurality of small resistors connected to a main resistor in series. Referring to FIGS. 1 and 2, in order to compensate the deviation of output voltage, a fine tuning circuit B is connected to a main resistor A1 of a bandgap A in series, and the fine tuning circuit B includes a plurality of resistors B1 connected to the main resistor A1 in series, and each resistor B1 is connected to a fuse B2 in parallel, such that each resistor B1 is used for fine tuning the absolute value of the main resistor A1. The fine tuning is achieved based on whether or not the fuse B2 connected to each resistor B1 in parallel is fused.

But the aforesaid prior art bandgap has numerous drawback as following.

1. After the bandgap A is fabricated in a chip. To achieve both positive and negative fine tunings, all fuses B2 are not fused (short-circuited) before the chip is processed. So the voltage A2 of the bandgap A must be too low (as shown in FIG. 2).

2. The prior art fuse B2 uses a current for fusing. When the current is controlled improperly, the bandgap A will be damaged, and thus the bandgap A will lose the function.

SUMMARY OF THE INVENTION

The present invention has been accomplished under the circumstance in view. It is therefore the main object of the present invention to use a logic controller to control the electric connection of a transistor switch, so as to fine tune the absolute value of a main resistor of the bandgap, such that the voltage outputted from the bandgap is not too low.

It is another object of the present invention to use a detect circuit to detect whether or not a fuse is fused, and output a voltage level signal to a logic controller, such that when the fuse is fused, since the current is not directly connected to the bandgap, the current of the circuit is still controlled properly and the bandgap will not be damaged or lose the function.

BRIEF DESCRIPTION OF THE DRAWINGS

FIG. 2 is a voltage output chart of a prior art bandgap.

FIG. 4 is a voltage output chart of a detect/modulate circuit according to the present invention.

DETAILED DESCRIPTION OF THE PREFERRED EMBODIMENTS

Figure 1:
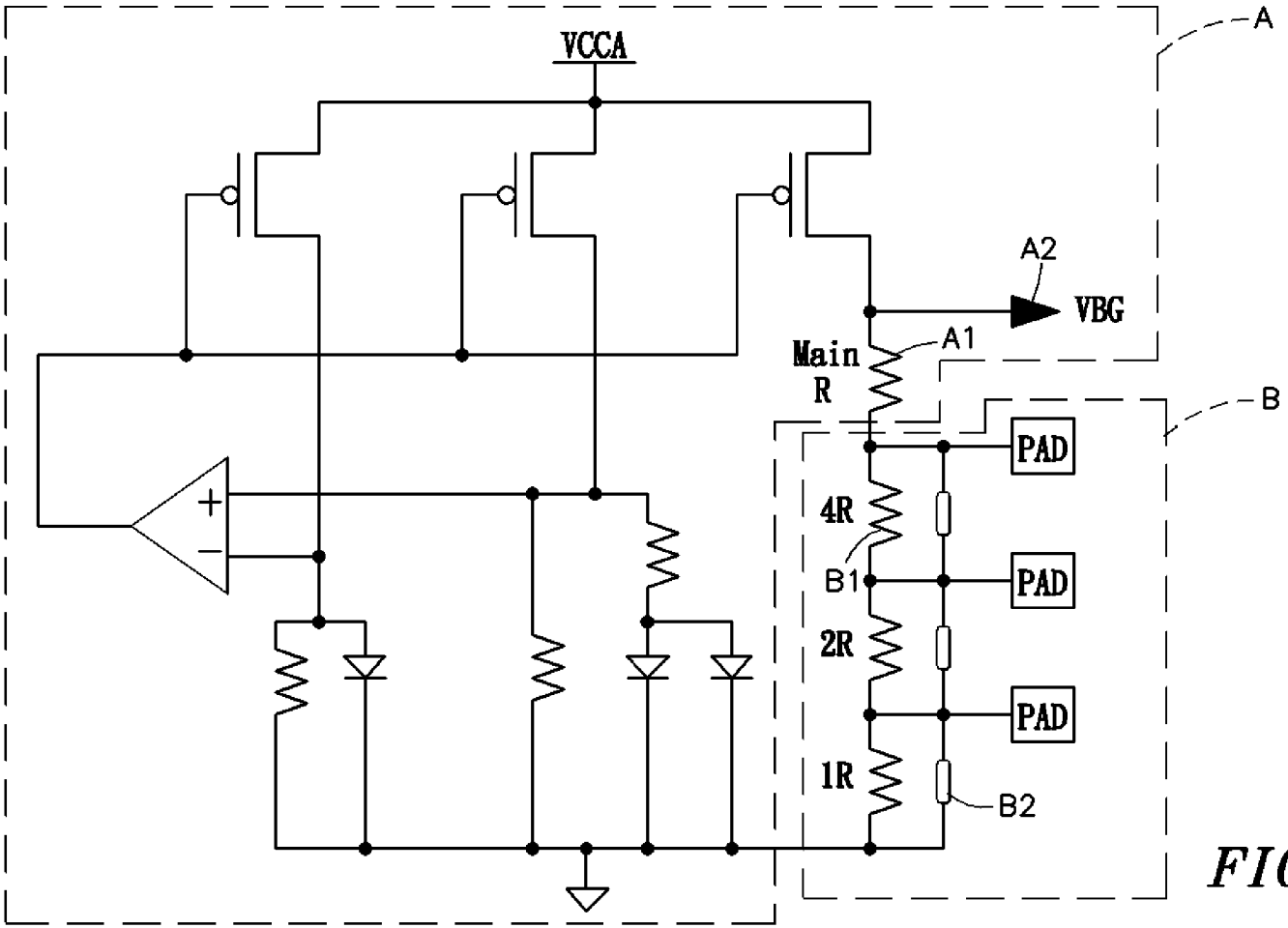
FIG. 1 is a circuit diagram of a prior art bandgap.
Figure 3:
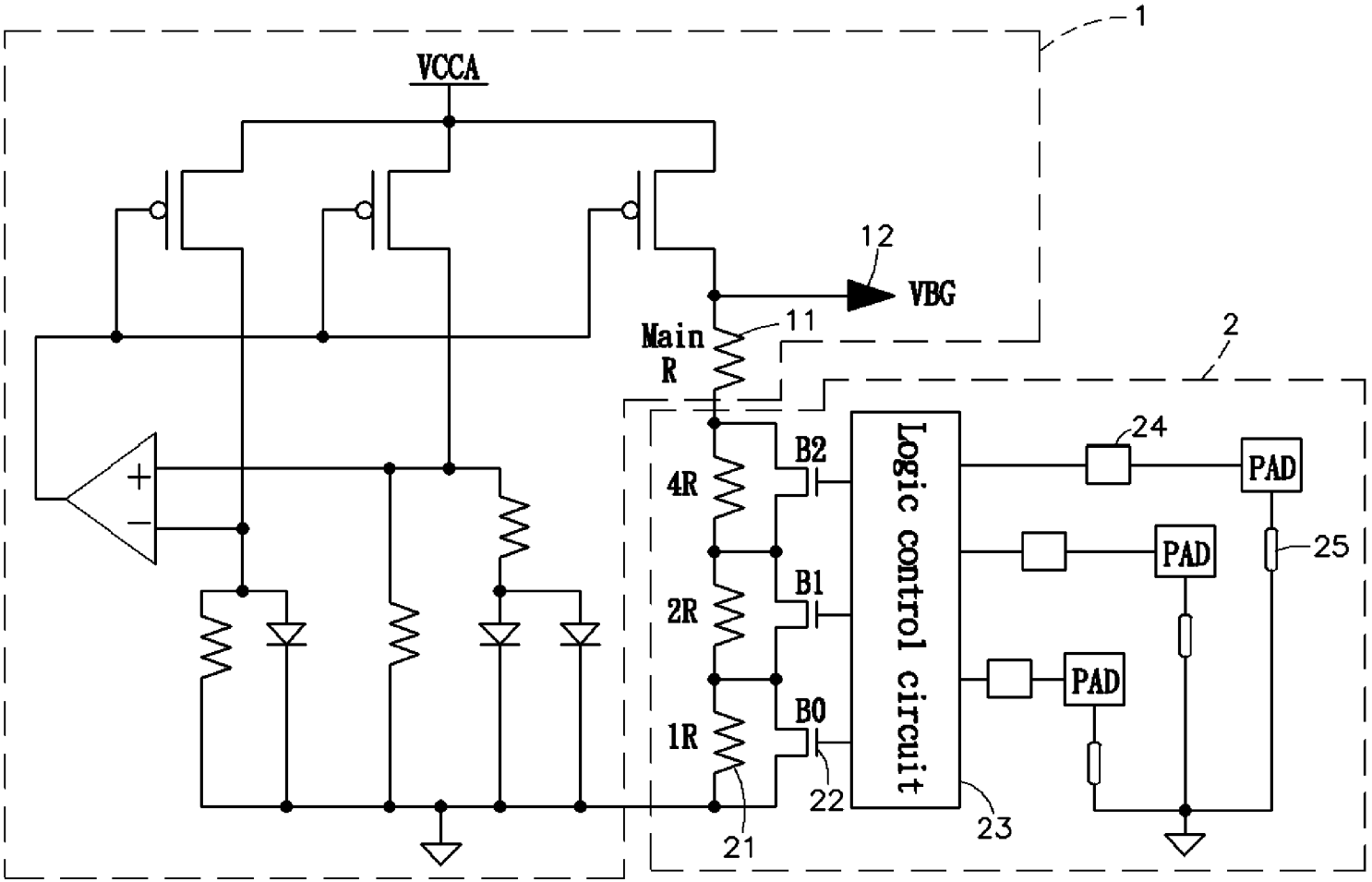
FIG. 3 is a circuit diagram of a detect/modulate circuit according to the present invention.

Referring to FIG. 3, a main resistor 11 of a bandgap 1 is connected to a detect/modulate circuit 2, and the detect/modulate circuit 2 includes a plurality of modulate resistors 21 connected to the main resistor 11 in series, and each modulate resistor 21 is connected to a transistor switch 22 in parallel, and each transistor switch 22 is connected to a logic controller 23, and the logic controller 23 is connected to a plurality of detect circuits 24 and fuses 25 corresponding to the quantity of the transistor switches 22.

Referring to FIGS. 3 and 4, when the detect/modulate circuit 2 fine tunes a voltage (VBG) 12 outputted from the bandgap 1, each detect circuit 24 will detect whether or not the fuse 25 is fused. If the fuse 25 is fused, then the detect circuit 24 will output a high level voltage to the logic controller 23. On the other hand, if the fuse 25 is not fused, then the detect circuit 24 will output a low level voltage to the logic controller 23. When the logic controller 23 receives a voltage level signal, then the logic controller 23 will convert the voltage level signal "0" or "1" according to a logic conversion table to control the corresponding transistor switch 22, such that the main resistor 11 of the voltage generator 1 uses each modulate resistor 21 to fine tune an absolute value of the main resistor 11. Therefore, the logic controller 23 can be used to modulate the electric connection of the transistor switches 22 before a chip is processed, so as to prevent the voltage 12 of the bandgap 1 being too low. Even if the current is short circuit and the control is improper, the bandgap 1 will not be damaged and loses the function.

Further, the transistor switch 22 can be an NMOS or a PMOS, and this preferred embodiment adopts the NMOS for description.

Figure 5:
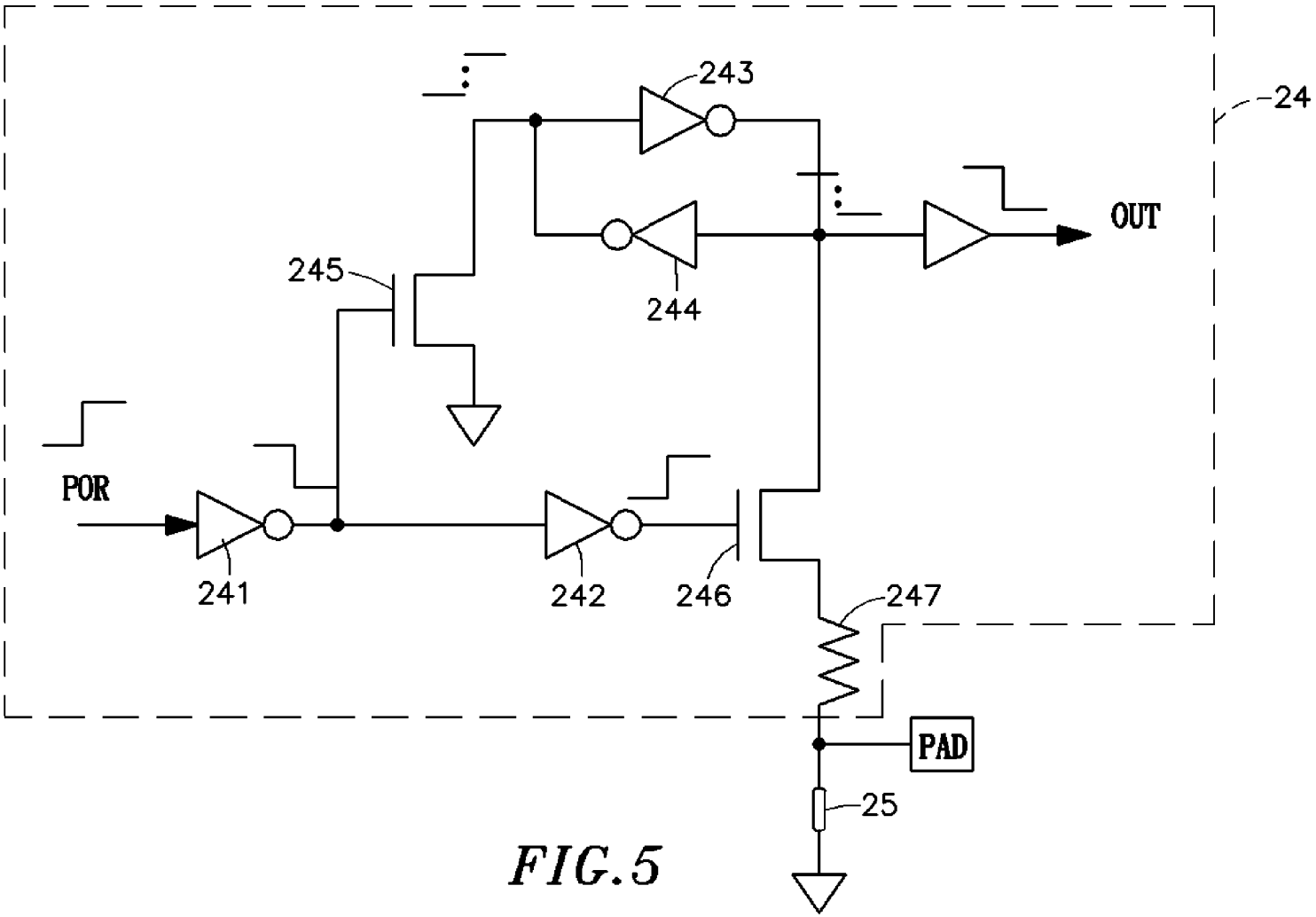
FIG. 5 is a circuit diagram of a detect circuit according to the present invention.
Figure 6:
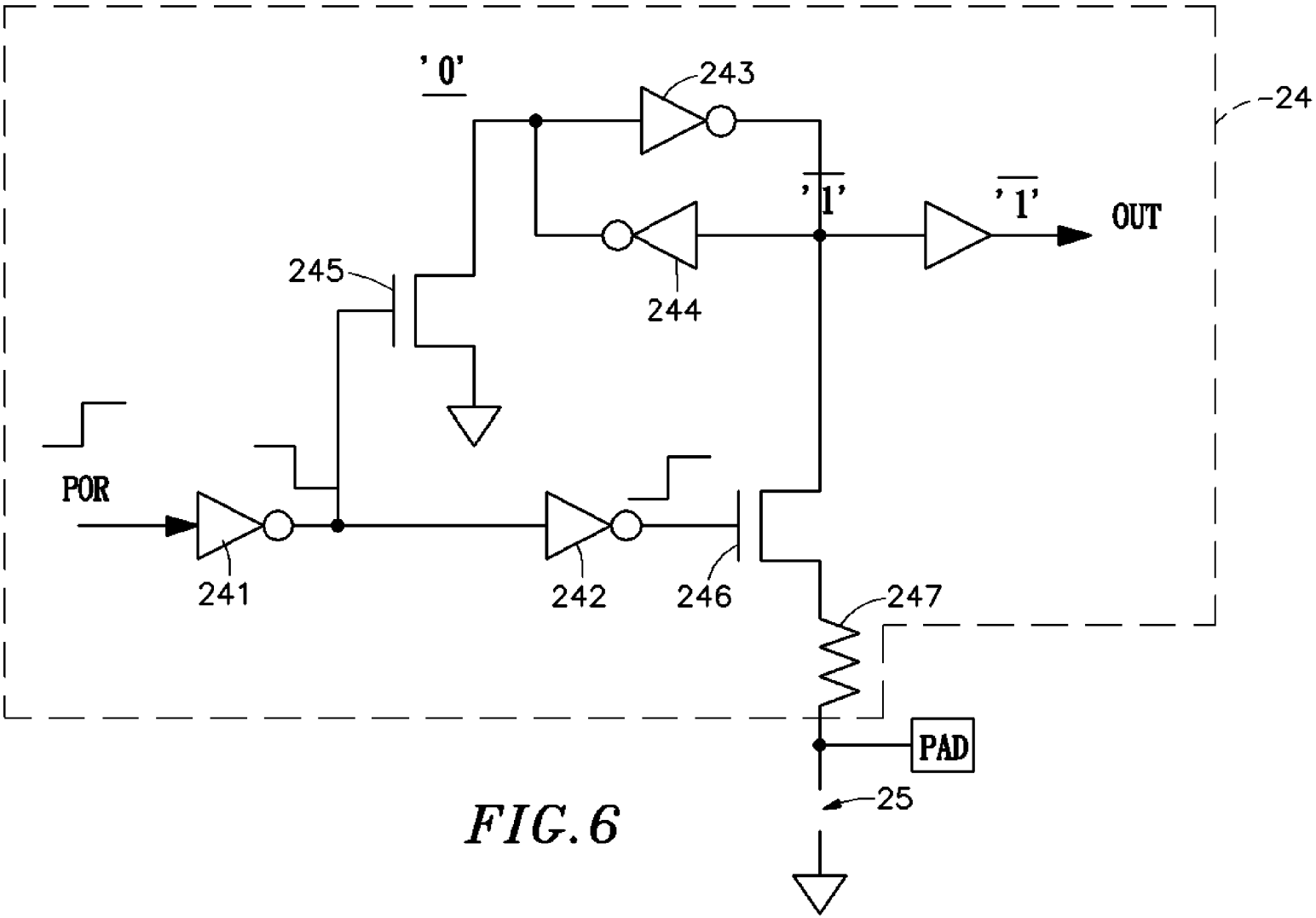
FIG. 6 is another circuit diagram of a detect circuit according to the present invention.

Referring to FIGS. 5 and 6, the detect circuit 24 includes a first inverter 241, and an output end of the first inverter 241 is connected separately to an input end of a second inverter 242 and a first transistor switch 245, and a source of the first transistor switch 245 is connected separately to an input end of a third inverter 243 and an output end of a fourth inverter 244, and an output end of the second inverter 242 is connected to a second transistor 246, and a source of the second transistor 246 is connected separately to an output end of the third inverter 243 and an input end of the fourth inverter 244, and a drain of the second transistor 246 is connected to a resistor 247, and the resistor 247 is connected to a PAD. When the fuse 25 is not fused, the action will be as shown in FIG. 5. By that time, the detect circuit 24 outputs a low level voltage to the logic controller 23. When the fuse 25 is fused, the action will be as shown in FIG. 6. By that time, the detect circuit 24 outputs a high level voltage to the logic controller 23, such that the logic controller 23 outputs "0" or "1" to the corresponding transistor switch 22 according to the detected voltage level signal and the logic conversion table to control the electric connection of each transistor switch 22, and thus the main resistor 11 of the bandgap 1 uses each modulate resistor 21 to fine tune the absolute value of the main resistor 11, so as to prevent any deviation.

The detect/modulate circuit of the present invention improves the prior art are described as follows.

(1) The present invention comprises a plurality of modulate resistors, and each modulate resistor is connected to the transistor switch in parallel, and each transistor switch is connected to the logic controller, such that when the logic controller receives the detected voltage level signal, the logic circuit will output "0" or "1" to the corresponding transistor switch according to the logic conversion table, so as to control the electric connection of each transistor switch and let the main resistor of the bandgap use the modulate resistors of the detect/modulate circuit to fine tune the absolute value, and thus the voltage outputted by the bandgap will not be too low.

(2) The present invention uses the detect circuit to detect whether or not the fuse is fused and outputs the voltage level signal to the logic controller to control the electric connection of each transistor switch. When the fuse is fused, since the detect circuit is not directly connected to the bandgap, the current is not controlled properly and the bandgap will not be damaged or lose the function.

(3) The present invention adds the detect circuit and the logic controller to fine tune the absolute value of the bandgap without adding any PAD or occupying too much space.

A prototype of detect/modulate circuit has been constructed with the features of FIGS. 3~6. The detect/modulate circuit functions smoothly to provide all of the features discussed earlier.

Although a particular embodiment of the invention has been described in detail for purposes of illustration, various modifications and enhancements may be made without departing from the spirit and scope of the invention.

What is claimed is:

1. A detect/modulate circuit, for modulating a voltage of a bandgap, and said detect/modulate circuit being connected to a main resistor of said bandgap, and said detect/modulate circuit comprising a plurality of modulate resistors connected to said main resistor in series, and said each modulate resistor being connected to a transistor switch in parallel, and said each transistor switch being connected to a logic controller, and said logic controller being connected in sequence with a plurality of detect circuits and fuses corresponding to the quantity of said transistor switches, wherein said each detect circuit detects whether or not said fuse is fused, and outputs a voltage level signal to said logic controller according to the situation of said fuse, so that said logic controller controls a electric connection of said each transistor switch according to a logic conversion table.

2. The detect/modulate circuit as claimed in claim 1, wherein said transistor switch is a PMOS.

3. The detect/modulate circuit as claimed in claim 1, wherein said transistor switch is an NMOS.

4. A detect/modulate circuit, for modulating a voltage of a bandgap, and said detect/modulate circuit being connected to a main resistor of said bandgap, and said detect/modulate circuit comprising:

a plurality of detect circuit;

a plurality of modulate resistors, being connected to said main resistor of said bandgap in series;

a plurality of transistor switches, being separately connected to said each modulate resistors in parallel;

a logic controller, being connected between said transistor switches and said detect circuits, and said logic controller receiving a voltage level signal transmitted from said detect circuit to control the electric connection of said transistor switch;

a plurality of fuses, being separately connected to said each detect circuit;

wherein said each detect circuit including a first inverter, and an output end of said first inverter being separately connected to an input end of a second inverter and a first transistor switch, and a source of said first transistor switch being separately connected to an input end of a third inverter and an output end of a fourth inverter, and an output end of said second inverter being connected to a second transistor, and a source of said second transistor being connected to an output end of said third inverter and an input end of said fourth inverter, and a drain of said second transistor being connected to a resistor.

5. The detect/modulate circuit as claimed in claim 4, wherein said transistor switch, said first transistor switch and said second transistor are NMOS.

* * * * *